US007971710B1

(12) United States Patent
Zaher

(10) Patent No.: US 7,971,710 B1
(45) Date of Patent: Jul. 5, 2011

(54) WORKOUT SCHEDULE FITNESS BAND

(76) Inventor: Margo Zaher, Tonawanda, NY (US)

( * ) Notice: Subject to any disclaimer, the term of this patent is extended or adjusted under 35 U.S.C. 154(b) by 0 days.

(21) Appl. No.: 12/387,732

(22) Filed: May 7, 2009

(51) Int. Cl.
*A63B 69/00* (2006.01)

(52) U.S. Cl. ..... 206/216; 206/315.1; 283/61; 482/148; 40/310

(58) Field of Classification Search ..... 206/216, 206/315.1; 116/222, 225, 306, 307, 317; 40/310; 248/444, 441.1, 447.1, 448, 451, 248/460; 281/5, 12; 224/575, 101, 478; 482/44, 79, 148; 283/61, 62, 36
See application file for complete search history.

(56) References Cited

U.S. PATENT DOCUMENTS

| | | | | | |
|---|---|---|---|---|---|
| 9,797 | A | | 7/1881 | Marks | |
| 753,457 | A | | 3/1904 | Weissbrod | |
| 2,091,346 | A | * | 8/1937 | Wright | 40/310 |
| 2,135,830 | A | * | 11/1938 | Neher | 40/310 |
| 2,139,031 | A | * | 12/1938 | Neher | 40/310 |
| 2,216,366 | A | * | 10/1940 | Greene | 40/310 |
| 2,221,761 | A | * | 11/1940 | Fairbanks | 40/310 |
| 2,422,314 | A | * | 6/1947 | Rheinstrom | 206/232 |
| 3,382,779 | A | * | 5/1968 | Lynas | 493/276 |
| 4,557,215 | A | | 12/1985 | Petersson | |
| 4,906,025 | A | | 3/1990 | Schreindl | |
| 5,150,785 | A | | 9/1992 | Kelley et al. | |
| D332,970 | S | | 2/1993 | Myers | |
| 5,351,851 | A | | 10/1994 | Powell | |
| 5,386,933 | A | | 2/1995 | Greene et al. | |
| 5,531,481 | A | | 7/1996 | Wiltshire | |
| 5,704,067 | A | | 1/1998 | Brady | |
| 5,759,043 | A | | 6/1998 | Craig | |
| 6,004,033 | A | | 12/1999 | Cirone | |
| 6,401,993 | B1 | | 6/2002 | Andrino | |
| 6,793,075 | B1 | | 9/2004 | Jeter | |
| 6,802,279 | B1 | * | 10/2004 | Johnson | 116/306 |
| 7,041,032 | B1 | * | 5/2006 | Calvano | 482/4 |
| 7,614,434 | B2 | * | 11/2009 | DeMichele | 150/145 |
| 7,837,596 | B2 | * | 11/2010 | Astilean | 482/8 |
| 2004/0134106 | A1 | * | 7/2004 | Kim | 40/310 |
| 2004/0244242 | A1 | * | 12/2004 | Maliner et al. | 40/310 |
| 2008/0220195 | A1 | | 9/2008 | Henshaw | |
| 2008/0245831 | A1 | | 10/2008 | Simon | |
| 2009/0178313 | A1 | * | 7/2009 | McManigal | 40/310 |

FOREIGN PATENT DOCUMENTS

| | | |
|---|---|---|
| EP | 0865015 | 9/1998 |

* cited by examiner

*Primary Examiner* — Jacob K Ackun, Jr.
(74) *Attorney, Agent, or Firm* — Simpson & Simpson, PLLC

(57) ABSTRACT

A workout aid including a beverage container, and a band secured about the beverage container, the band comprising a first surface and a second surface, wherein at least a portion of the first surface is matingly engaged against the beverage container, a first end and a second end, a means for detachably securing the first end of the band to the second end of the band, and wherein the second surface of the band is opposite from the first surface and has a schedule printed thereon or viewable therethrough, wherein the schedule includes a plurality of cells arranged in at least one column and at least one row.

16 Claims, 4 Drawing Sheets

WORKOUT SCHEDULE FITNESS BAND

FIELD OF THE INVENTION

The invention relates to workout schedules, more specifically to a band having a workout schedule printed thereon arranged to be secured about a water bottle.

BACKGROUND OF THE INVENTION

Workout schedules and related aids are known in the art. These aids and schedules enable users to keep track of their exercise routines, particularly at a gym or fitness center. Prior art workout schedules can be as simple as a piece of scratch paper on which a user jots down the exercises she performs, the number of repetitions performed, and if appropriate, the weight used. U.S. Pat. No. 5,759,043 (Craig) teaches a physical exercise management planner. The Craig planner includes cards having a schedule printed thereon, with a different card for each exercise the user performs. The user can document her progress by noting the date, weight, and repetitions completed for each specific exercise. Even though the cards are taught to be small and therefore portable, they still represent an additional item which a user must bring to and keep track of while at a gym.

People undergoing physical exertion require an increased level of water intake to remain hydrated. For this reason, people often bring a bottle of water or sports drink with them to the gym, so that they can remain hydrated throughout their workouts. Thus, many gym-goers traditionally must separately bring both a water bottle and a workout schedule with them to the gym. This results in multiple items that a person must monitor while at the gym. Thus, what is needed is a way for people to reduce the number of items they must carry and monitor while at a gym.

BRIEF SUMMARY OF THE INVENTION

The present invention broadly comprises a workout aid including a flexible band for securing about a beverage container, the band having first and second ends and first and second opposite surfaces, a means for detachably securing the first end of the band to the second end of the band, a workout schedule printed on or viewable through the first surface of the band, wherein the schedule includes a plurality of cells arranged in a plurality of columns and a plurality of rows, wherein the cells are arranged to contain inputs written directly onto the first surface by a writing implement.

In one embodiment, the means for detachably securing the first and second ends comprises a hook-and-loop type fastening means arranged between the first and second ends. In another embodiment, the writing implement includes a piece of hook-and-loop fastening material which enables the writing implement to detachably secure to the hook-and-loop fastening means. In yet another embodiment the first surface of the flexible band is operatively arranged to be writable and erasable.

In one embodiment, the flexible band is laminated or coated in a plastic or non-porous material. In a further embodiment the band has the schedule printed thereon before the band is coated or laminated in the plastic or non-porous material. In another embodiment the writing implement is a grease pencil, permanent marker, dry-erase marker, or wet-erase marker. In yet another embodiment the aid further comprises a backing affixed to the band opposite from the first side, wherein the backing comprises the second surface and increases a coefficient of friction between the beverage container and the band.

In one embodiment, the schedule includes at least one heading pre-printed in at least one of the cells. In another embodiment, the cells in each column are arranged generally in a direction defined longitudinally by the beverage container and the cells in each row are arranged in a direction defined circumferentially about the beverage container.

The current invention also broadly comprises a workout aid including a beverage container, and a band secured about the beverage container, the band comprising a first surface and a second surface, wherein at least a portion of the first surface is matingly engaged against the beverage container, a first end and a second end, a means for detachably securing the first end of the band to the second end of the band, and wherein the second surface of the band is opposite from the first surface and has a schedule printed thereon or viewable therethrough, wherein the schedule includes a plurality of cells arranged in at least one column and at least one row.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
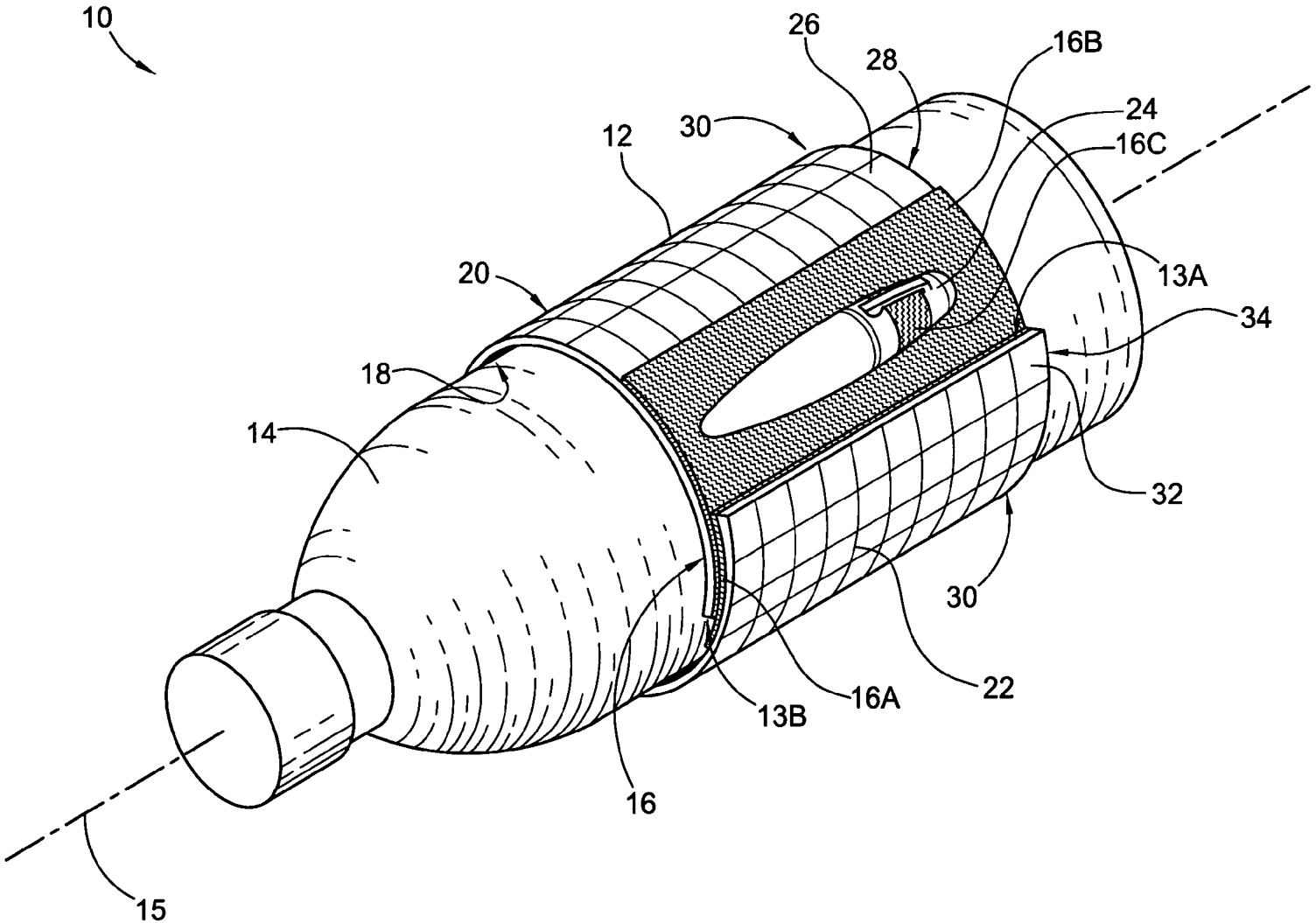
FIG. 1 is a perspective view of a current invention workout aid having a blank schedule.

Referring now to the drawings, FIG. 1 illustrates a perspective view of workout aid 10. The aid includes band 12 secured about bottle 14. It can be seen that the band wraps circumferentially about bottle 14. In other words, the band is secured about bottle 14 by folding or curving the band about central axis 15 of the bottle. In a preferred embodiment, the band has first and second ends 13A and 13B, which are fastened together by detachable securing means 16. In the shown embodiment, the detachable securing means comprises corresponding pieces of hook-and-loop material 16A and 16B. Materials 16A and 16B can be either of the hook or the loop type materials, as long as they together comprise a means of detachably securing the ends of band 12 together. Furthermore, it should be understood that other means of detachably securing the ends of the bands together are known in the art, including snaps, buckles, reusable adhesives, or the like.

Band 12 includes mating surface 18 and writing surface 20, which are opposite from each other. Surface 18 is generally referred to as the mating surface because it wraps around and matingly engages against at least a portion of the surface of the bottle. Surface 20 is generally referred to as the writing surface because it is arranged to be written on by a user to fill out schedule 22. Schedule 22 is a grid including a plurality of cells which are arranged in a plurality of columns and rows. For example, cell 26 is located in column 28 and row 30, and cell 32 is located in column 34 and row 30. A user accordingly fills out schedule 22 by using a writing implement to enter values into cells, as will be discussed infra. In the shown embodiment, the columns and rows are perpendicular with respect to each other. The cells of the columns are preferably arranged along the longitudinal direction of bottle 14, while the cells of the rows are arranged circumferentially about the bottle. Advantageously, when the bottle is held upright by a user, the writing of schedule 22 is properly aligned and can be read left-to-right and top-to-bottom.

In the shown embodiment, writing implement 24 is included to enable a user to complete entries in the cells of workout schedule 22. In a preferred embodiment, the writing implement includes a piece of hook-and-loop fastening material 16C which enables the writing implement to affix to material 16A and/or 16B. In a preferred embodiment, the material of surface 20 of band 12 and is selected so that the writing of writing implement 24 can be completely erased from the writing surface.

In various embodiments, band 12 could be created by coating or laminating a sheet of paper, cardstock, or other thin flexible sheets, with a plastic or other non-porous material. In such embodiments, the plastic or non-porous material would form the writing surface. Non-porous materials, such as melamine or other plastics, are preferred because ink from markers is less likely to permanently stain non-porous materials. If the band is to be laminated or coated in a transparent material, the schedule can be printed on the band before the band is laminated. In this way, the schedule will be protected from general wear, but will still be viewable through the writing surface.

Likewise, writing implement 24 could be any implement known in the art which is erasable, such as a grease pencil, dry-erase marker, wet erase marker, liquid chalk marker, or the like. Furthermore, a permanent marker could be used, but this may require rubbing alcohol, or some other solvent, to remove from the writing surface. In a preferred embodiment, a combination of the writing implement and the material of writing surface 20 should be chosen so that the writing from the implement does not too easily erase; a user should not accidently erase her entries simply by picking up the workout aid with sweaty hands. Thus, using a sufficiently non-porous writing surface material in combination with a permanent marker may require a non-water based solvent to remove writing from the writing surface, but the writing would not accidently erase due to normal handling of the bottle. By making surface 20 erasable, a user can simply erase all entries in schedule 22 and start over with a blank schedule. Users may want to transcribe their entries to a more permanent location, such as into a notebook or electronic computer file, before erasing entries off workout aid 10.

In the shown embodiment, material 16A is affixed to mating surface 18 and material 16B is affixed to mating surface 20. In this embodiment, band 12 wraps completely around bottle 14, so that end 13A overlaps end 13B and material 16A on surface 18 engages with material 16B on surface 20. It should be understood that in another embodiment, material 16A could be affixed to surface 20 and material 16B to surface 18 so that end 13A instead overlaps end 13B.

Figure 2:
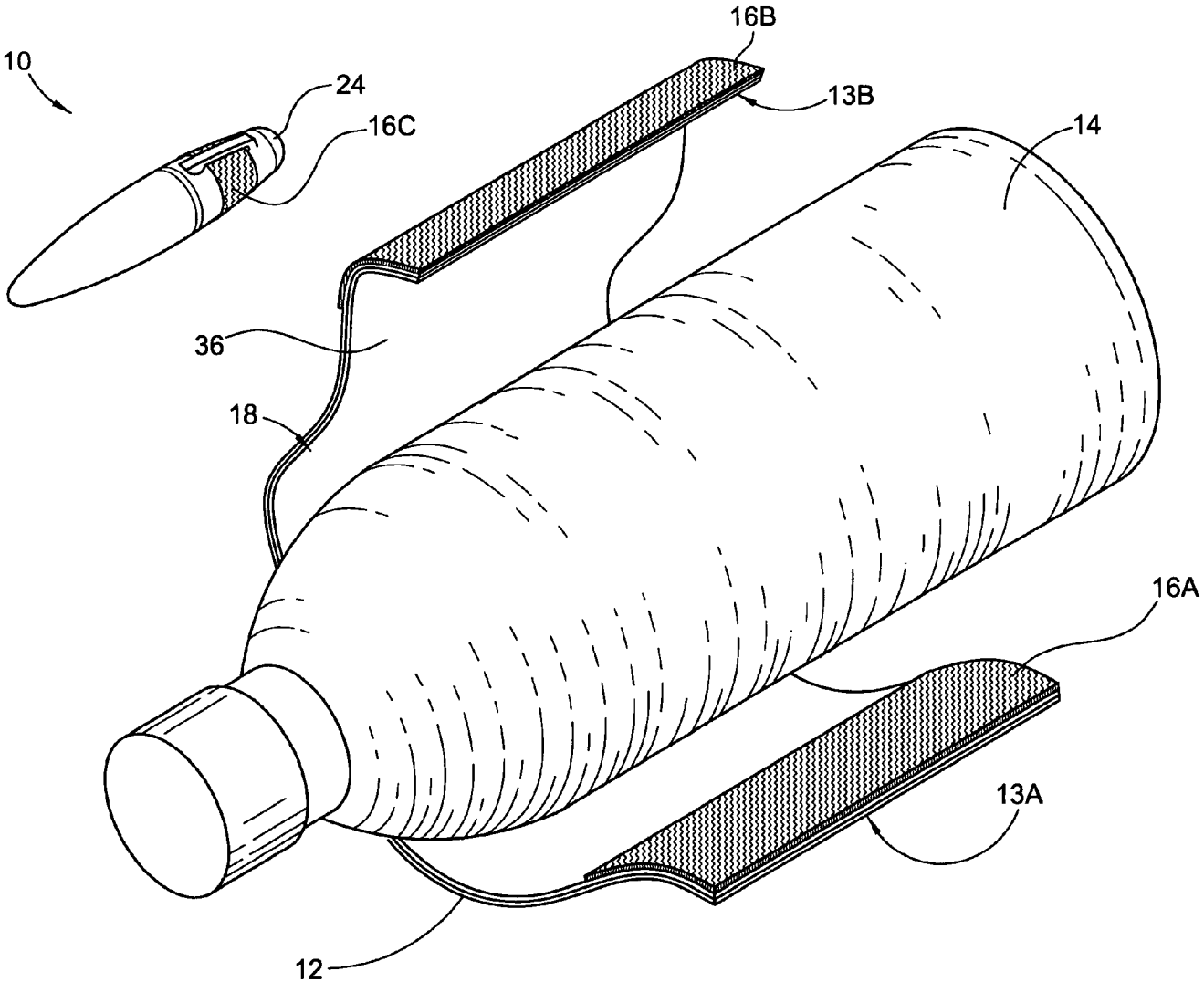
FIG. 2 is an exploded view of the workout aid shown in FIG. 1.

Band 12 is shown opened with detachable securing means 16 detached in FIG. 2. In a preferred embodiment, band 12 is preferably made of a flexible or semi-flexible material. This enables a user to tightly secure the band about various sizes of bottles, or about containers having different contours. As discussed with respect to FIG. 1, mating surface 18 wraps about the bottle, and the corresponding pieces of hook and loop material 16A and 16B are engaged together.

Bottle 14 is shown as a generic beverage container, which is essentially a hollow cylinder having one end tapered down to an opening that includes a cap. Similar bottles are known in the art. It should be appreciated that any other bottle or beverage container known in the art could be substituted for bottle 14, such as a pre-filled, store bought container holding water, juice, or a sports drink, soft plastic sport bottles, hard plastic bottles, aluminum bottles, or other containers suitable for holding a liquid.

Containers manufactured from certain materials may result in a low coefficient of friction between the container and band 12. For example, polyethylene bottles have a generally low coefficient of friction. For this reason, backing 22 may be included affixed opposite from surface 20. The backing would then comprise the mating surface 18, and would be made from a material which enables a higher coefficient of friction, such as a rubber, so that the band more reliably secures about bottle 14.

Figure 3A:
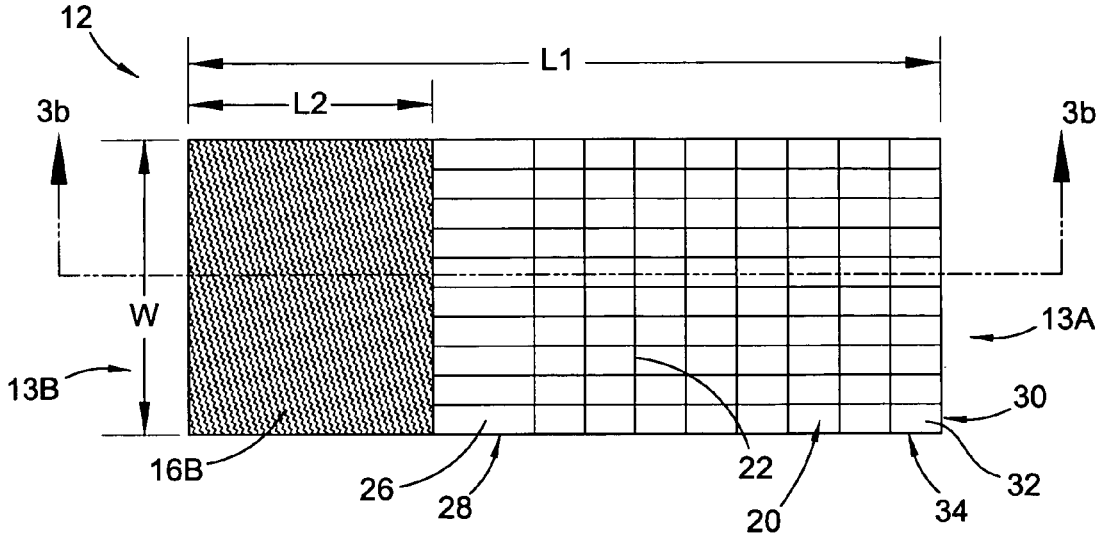
FIG. 3*a* is a front view of a band of the workout aid shown in FIGS. 1 and 2.
Figure 3B:
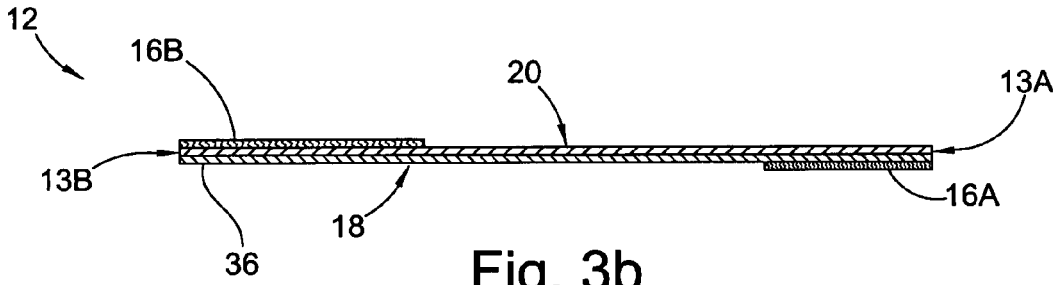
FIG. 3*b* is a cross-sectional view of the band taken generally along line 3*b*-3*b* in FIG. 3*a;*
Figure 3C:
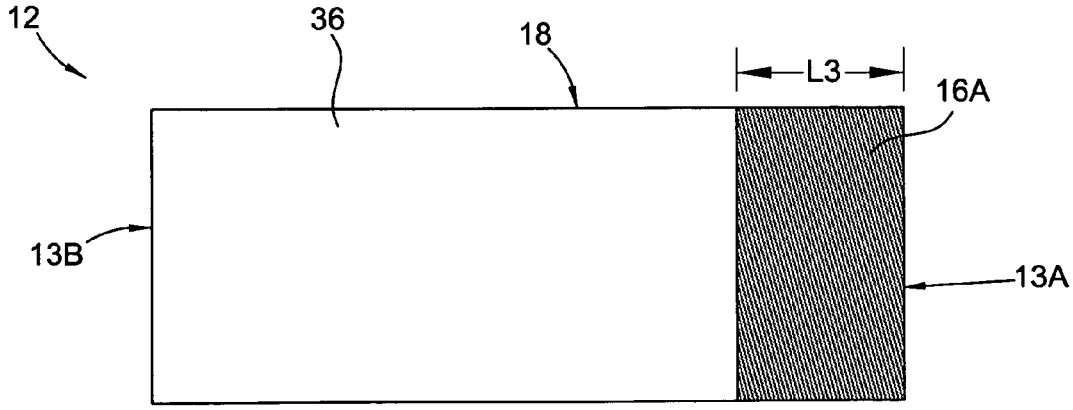
FIG. 3*c* is a rear view of the band shown in FIG. 3*a*.

The following paragraphs refer to FIGS. 3*a-c*. In the shown embodiment, the band is rectangular in shape having length L1 and width W. Hook-and-loop material 16B is shown on the left side of band. Schedule 22 can be seen printed on the remainder of band 12. The schedule comprises a plurality of cells arranged in columns and rows. Although not shown, in addition to the columns and rows, headings for each column and row can be permanently pre-printed on the band. For example, the names of exercises could be printed in the first (leftmost) cell of each row, and the name of each day of the week could be printed in the first (top) cell in each column.

Length L1 must be chosen so that it is greater than the circumference of the bottle around which the band is to be secured, or else end 13A could not secure to end 13B. Length L2 should be chosen so that varying sizes of bottles can be used with a single band 12, by enabling the ends to overlap. That is, band 12 can fit any bottle having a circumferential distance that is between the values of L1 and (L1-L2), without interfering with schedule 22. Width W should be chosen so that is less than the height of the bottle around which the band is to be secured.

Like length L2, having material 16A of length L3 enables band 12 to fit a range of differently sized bottles. In the shown embodiment, backing 36 is included on the band. The backing increases the coefficient of friction between the bottle and the band so that the band will not easily slip off the bottle. In the shown embodiment, backing 36 entirely covers one side of the band, but it should be appreciated that the backing may not be included, or may only cover a portion of the band.

Figure 4:
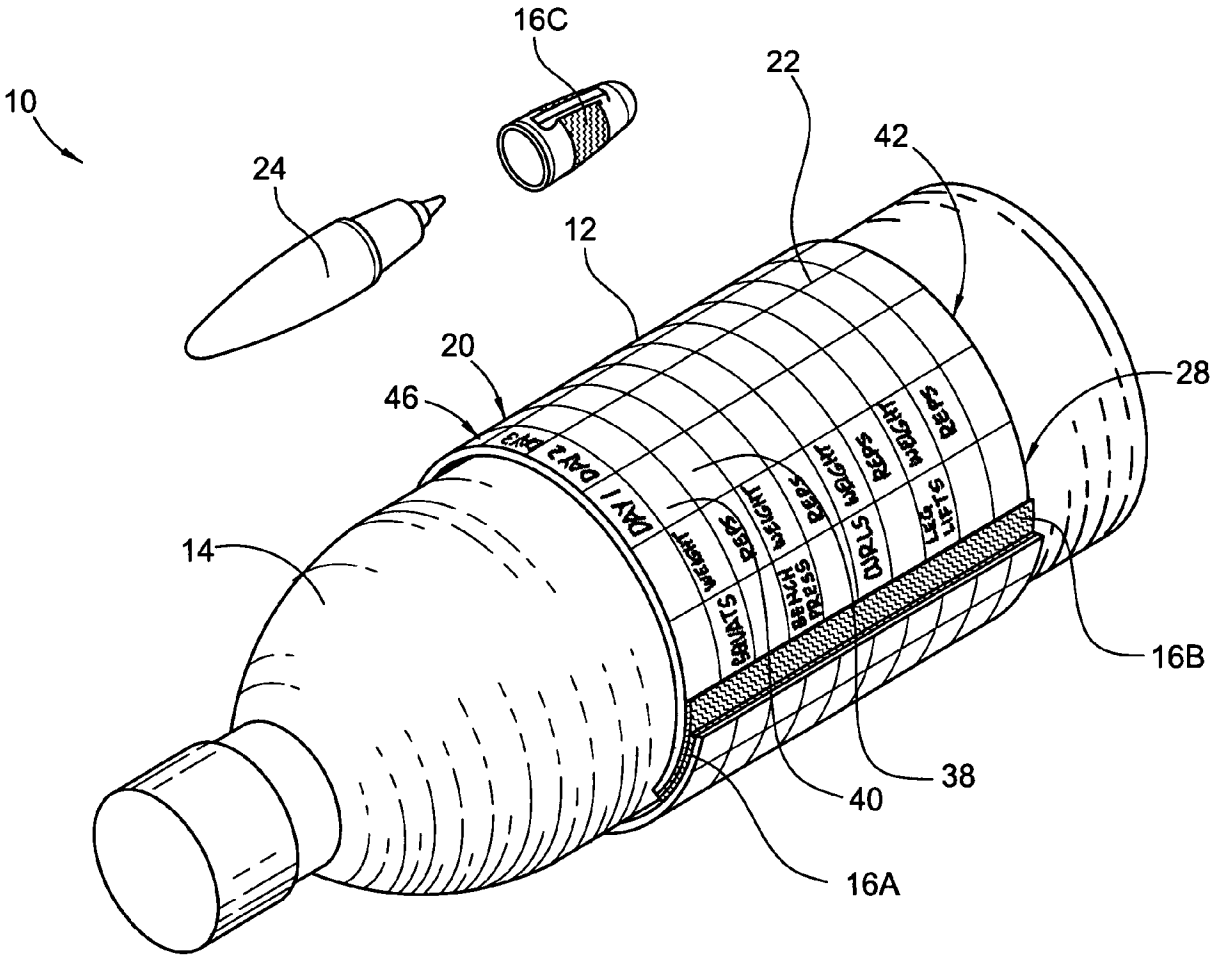
FIG. 4 is perspective view of a workout aid having a schedule with printed headings.

FIG. 4 illustrates an example of band 12 which has a schedule that has been partially completed. In the shown example, the headings are included in column 28 and row 46; the days are indicated in the first cell of each column (DAY 1, DAY 2, . . . ) and the name of each exercise in the first cell of each row (SQUATS, BENCH PRESS, . . . ). Alternatively, the headings may include the names of each day (MONDAY, TUESDAY, . . . ), dates (Apr. 29, 2009, Apr. 30, 2009, . . . ), or any other heading desired by the user. The cells next to each exercise name may also be considered headings, and are labeled 'REPS' and 'WEIGHT.' These headings may be filled out by the user using the writing implement, or may be pre-printed on the band, as desired.

After a user completes an exercise, she can mark her progress on the schedule using a writing implement. For example, if on the first day (DAY 1) the user does squats using a weight of 250 lbs and completes 15 repetitions, she would write "15" in cell 38 adjacent to 'REPS' and "250" in cell 40 adjacent to 'WEIGHT' in column 42 under the heading 'DAY 1.' For each exercise completed on the first day, the user would write the name of the exercise performed in the appropriate cell in column 28, then record the weight and number of reps completed in the appropriate cells in column 42. The user would repeat for the remainder of the days. If a user does not do a particular exercise on a day, she simply would not fill out the cells corresponding to that exercise for that day, or may signify not doing the exercise with a dash, x, or other marking. If an exercise does not require a weight or a repetition amount, such as a cardio work out, a user could instead enter the amount of time exercised, and/or distance run, walked, swam, or bicycled.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A workout aid comprising:

a flexible band for securing about a beverage container, said band having first and second ends and first and second opposite surfaces;

a means for detachably securing said first end of said band to said second end of said band;

a workout schedule printed on or viewable through said first surface of said band, wherein said workout schedule comprises a plurality of cells arranged in a grid having a plurality of columns and a plurality of rows, wherein each cell comprises a pre-printed rectangle, wherein said plurality of columns includes a first subset of input columns, wherein each input column includes a first heading cell having first indicia pre-printed therein, said first indicia representative of days or dates, said first heading cells arranged in a heading row, and wherein at least one blank cell is located in each input column;

wherein said at least one blank cell is initially empty and operatively arranged to receive inputs written directly onto said first surface by a writing implement while said band is secured about said beverage container, said inputs representative of exercises.

2. The workout aid recited in claim 1 wherein said means for detachably securing said first and second ends comprises a hook-and-loop type fastening means arranged between said first and second ends.

3. The workout aid recited in claim 2 wherein said writing implement includes a piece of hook-and-loop fastening material which enables said writing implement to detachably secure to said hook-and-loop fastening means.

4. The workout aid recited in claim 1 wherein said first surface of said flexible band is operatively arranged to be writable and erasable.

5. The workout aid recited in claim 1 wherein said flexible band is laminated or coated in a plastic or non-porous material.

6. The workout aid recited in claim 5 wherein said band has said plurality of cells printed thereon before said band is coated or laminated in said plastic or non-porous material.

7. The workout aid recited in claim 1 wherein said writing implement is a grease pencil, permanent marker, dry-erase marker, or wet-erase marker.

8. The workout aid recited in claim 1 further comprising a backing affixed to said band opposite from said first side, wherein said backing comprises said second surface and increases a coefficient of friction between said beverage container and said band.

9. The workout aid recited in claim 1 wherein said plurality of cells includes at least one heading pre-printed in at least one of said cells.

10. The workout aid recited in claim 9 wherein said cells in each column are arranged generally in a direction defined longitudinally by said beverage container and said cells in each row are arranged in a direction defined circumferentially about said beverage container.

11. The workout aid recited in claim 1, wherein said first subset of input columns includes seven columns, and said first heading cells of said seven columns includes "Monday", "Tuesday", "Wednesday", "Thursday", "Friday", "Saturday", and "Sunday" printed therein, respectively.

12. The workout aid recited in claim 1, wherein said plurality of rows includes a second subset of input rows, wherein said heading row is not in said second subset of input rows, wherein each input row includes a second heading cell having second indicia pre-printed therein, said second indicia representative of exercises, said second heading cells arranged in a first heading column, said first heading column not in said first subset of input columns, and wherein at least one of said blank cells is located in each of said input rows.

13. The workout aid recited in claim 12, wherein each input row includes a third heading cell having third indicia pre-printed therein, said third indicia representative of performance parameters of said exercises, said third heading cells arranged in a second heading column, said second heading column not in said first subset of input columns.

14. The workout aid recited in claim 12, wherein said second indicia comprises names of said exercises.

15. The workout aid recited in claim 13, wherein said third indicia includes "reps", "weight", "time", "distance", or combinations thereof, pre-printed in said third heading cells.

16. A workout system comprising:

a beverage container; and, a workout aid according to claim 1;

wherein said flexible band of said workout aid is secured about said beverage container.

* * * * *